United States Patent [19]

Conrad et al.

[11] 4,270,553

[45] Jun. 2, 1981

[54] PROCESS AND APPARATUS FOR EXPANDING TOBACCO

[75] Inventors: Lucas J. Conrad, Winston-Salem; Jackie L. White, Pfafftown, both of N.C.

[73] Assignee: R. J. Reynolds Tobacco Company, Winston-Salem, N.C.

[21] Appl. No.: 960,416

[22] Filed: Nov. 13, 1978

[51] Int. Cl.[3] ..... A24B 3/18

[52] U.S. Cl. ..... 131/291

[58] Field of Search ..... 131/140 P, 120, 121, 131/134, 135, 136, 138; 426/443, 445, 450, 449

[56] References Cited

U.S. PATENT DOCUMENTS

| | | | |
|---|---|---|---|
| 3,409,022 | 11/1968 | de la Burde | 131/140 P |
| 3,409,027 | 11/1968 | de la Burde | 131/140 P |
| 3,734,104 | 5/1973 | Buchanan | 131/140 P |
| 3,771,533 | 11/1973 | Armstrong et al. | 131/140 P |
| 3,837,481 | 9/1974 | Sturgis | 131/140 P |
| 3,881,498 | 5/1975 | Wochnowski | 131/140 P |
| 3,957,063 | 5/1976 | Wochnowski | 131/140 P |
| 3,978,867 | 9/1976 | Wochnowski | 131/140 P |
| 4,040,431 | 8/1977 | Ashworth et al. | 131/140 P |
| 4,071,304 | 1/1978 | Chauvin et al. | 426/443 |
| 4,076,030 | 2/1978 | Smith | 131/140 P |

FOREIGN PATENT DOCUMENTS

| | | | |
|---|---|---|---|
| 1013640 | 7/1977 | Canada | 131/140 P |
| 725015 | 8/1973 | South Africa | 131/140 P |
| 1375420 | 11/1974 | United Kingdom | 131/140 P |
| 1375820 | 11/1974 | United Kingdom | 131/140 P |
| 1484536 | 9/1977 | United Kingdom | 131/140 P |

*Primary Examiner*—V. Millin

*Attorney, Agent, or Firm*—Herbert J. Bluhm

[57] ABSTRACT

This invention relates to a process for expanding tobacco wherein tobacco impregnated with an expansion agent is rapidly heated in the presence of a fluidized bed of hot inert solid particles to effect expansion of the tobacco.

47 Claims, 10 Drawing Figures

PROCESS AND APPARATUS FOR EXPANDING TOBACCO

BACKGROUND OF THE INVENTION

In recent years a number of processes for expanding tobacco have been disclosed which involve rapidly heating tobacco that has been previously impregnated with an expansion agent. The expansion agents which have been proposed are organic or inorganic materials capable of rapid vaporization, expansive decomposition or other expansion under the heating conditions employed. The rapid formation and/or expansion of vapors or gases emanating from the expansion agent present in the tobacco is dependent in part on the rate of heating the impregnated tobacco. The rate of heating is, in turn, determined by the impregnant and moisture content of the tobacco, the temperature and heat capacity of the heating medium, the relative quantities of flow rates of the impregnated tobacco and heating medium, and the efficiency of the heat transfer between the heating medium and the impregnated tobacco.

SUMMARY OF THE INVENTION

The present invention relates to improvements in a tobacco expansion process wherein tobacco impregnated with an expansion agent is rapidly heated in the presence of hot inert solid particles maintained in a fluidized state to effect expansion of the tobacco. Use of the fluidized hot inert solid particles results in somewhat greater tobacco expansion than that obtained from prior art processes.

In accordance with one embodiment of this invention, tobacco is impregnated with an expansion agent by contacting the tobacco with the agent, the latter being in the form of a liquid, vapor or solution under the impregnation conditions used. Suitable expansion agents and methods of impregnation are described in the prior art including U.S. Pat. Nos. 3,524,451, 3,524,452, 3,575,178, 3,683,937, 3,693,631 and 3,882,874. Particularly preferred expansion agents are organic compounds which are essentially chemically inert to the tobacco and are capable of rapid vaporization or expansion at the temperatures to which the tobacco is subsequently subjected including, for example, aliphatic hydrocarbons such as butane, pentane, hexane, heptane and the corresponding unsaturated hydrocarbons; aliphatic alcohols such as methanol, ethanol, propanol and 2-propanol; ketones such as acetone, methyl ethyl ketone and diethyl ketone; cycloaliphatic hydrocarbons such as cyclopentane, cyclohexane and cyclohexene; and halogenated hydrocarbons such as ethyl chloride, methylene chloride, trichloroethylene, trichloromonofluoromethane and trichlorotrifluoroethane.

After the tobacco has been thoroughly impregnated, the impregnated tobacco is introduced into a heating zone where it is rapidly heated in the presence of a fluidized bed of hot, inert solid particles to effect expansion of the tobacco. Inert solid particles are defined herein as non-tobacco solid particles which exhibit no significant chemical reactivity toward tobacco or the impregnating agent under the processing conditions used and include beads of ceramic materials, metals, alumina, silica and similar materials which are stable at relatively high temperatures (i.e., melting points above approximately 300° C.). The term "solid particles" as used herein refers to materials other than liquids or gases at the processing temperatures contemplated but does include solid particles which are hollow such as, for example, hollow beads. Also, the inert solid particles should not give rise to undesirable flavor or aroma development in the tobacco under the processing conditions used. It is important that the size and quantity of the solid particles be such that good contact is achieved between the respective surface areas of the particles and the tobacco and that fluidization of the particles can be readily established and maintained by the fluidizing medium. Generally speaking, it is preferred that the solid particles have maximum and minimum dimensions between about 0.10 and 5 millimeters, more preferably between about 0.3 and 2 millimeters. The shape of the solid particles or beads is not particularly critical and it may, for example, be spherical or cylindrical. The surface of the particles or beads should be relatively free of projections or protuberances which might interfere with their separation from the expanded tobacco. The quantity of particles or beads necessary will depend on a number of factors including the size of the heating zone, the rate and manner of tobacco introduction into the heating zone and the temperature differential between the particles or beads and the impregnated tobacco. Preferably, the total weight of inert solid particles present in the heating zone should be at least equivalent to the dry weight of the tobacco present in the heating zone and, more preferably, the total weight of the particles should be at least three times the dry weight of the tobacco present in the heating zone.

The solid particles or beads are heated by appropriate means such as radiant heat energy, hot gases or contact with a suitable heat exchanging surface. Hot gases are particularly preferred for heating the particles because the heated gas stream may be passed upwardly through the bed of particles to establish and maintain the bed in a fluidized state. The heated particles or beads should preferably have a temperature between 100° and 300° C. at the time of contact with the impregnated tobacco. When a moving hot gas steam is used to heat the particles or beads, the gas stream should be heated to a temperature between 100° and 300° C. as measured at the point of initial contact with the bed of particles. Suitable means are also employed for bringing the impregnated tobacco and the particles or beads into contact and for separating the expanded tobacco from the particles or beads following the contacting step. For example, one or more screw-type conveyors may be used to feed impregnated tobacco into the heating zone in such a way that passage of the tobacco through the fluidized bed of inert beads will occur. The fluidizing medium provides a convenient means for separating the expanded tobacco from the inert particles by entrainment of the expanded tobacco in the gaseous medium and passage of the tobacco-containing gas stream through appropriate apparatus such as a cyclone separator to effect recovery of the expanded tobacco.

The residence time of the impregnated tobacco in the heating zone should be such that no significant charring of the tobacco will occur under the processing conditions employed. Generally, the residence time should be no more than about 2 minutes at the lower operating temperatures and shorter residence times are preferred as the temperature of the hot particles is increased. Expansion of the tobacco usually occurs within a short time after the initial contact with the hot solid particles although this time may vary somewhat depending on other factors such as impregnant and moisture content of the tobacco, relative quantities or flow rates of the impregnated tobacco and heating medium as well as the manner in which the tobacco is introduced into the heating zone.

A particularly preferred method for carrying out the disclosed process involves introducing the impregnated tobacco into a bed of hot inert solid particles which are heated and maintained in a fluidized state by a hot gas passing upwardly through the bed. Suitable apparatus which may be used to provide a fluidized bed of inert particles for laboratory scale puffing of tobacco includes commercially available fluidized sand baths. Basically, apparatus that is suitable for expanding tobacco according to the present invention comprises a quantity of inert particles or beads confined to an appropriate vessel or chamber, porous support and/or orifice means through which a gas is passed to effect fluidization of the inert particles or beads, means for heating the particles or beads, means for introducing impregnated tobacco into the heating zone where the fluidized particles or beads are maintained and means for recovering the resulting expanded tobacco from the vessel or chamber.

For a more complete understanding of the invention, reference is made to the accompanying drawings which are offered for illustrative purposes only and are not to be construed as limiting the invention, the scope of which is defined by the appended claims.

DETAILED DESCRIPTION OF THE PREFERRED EMBODIMENTS

Figure 1:
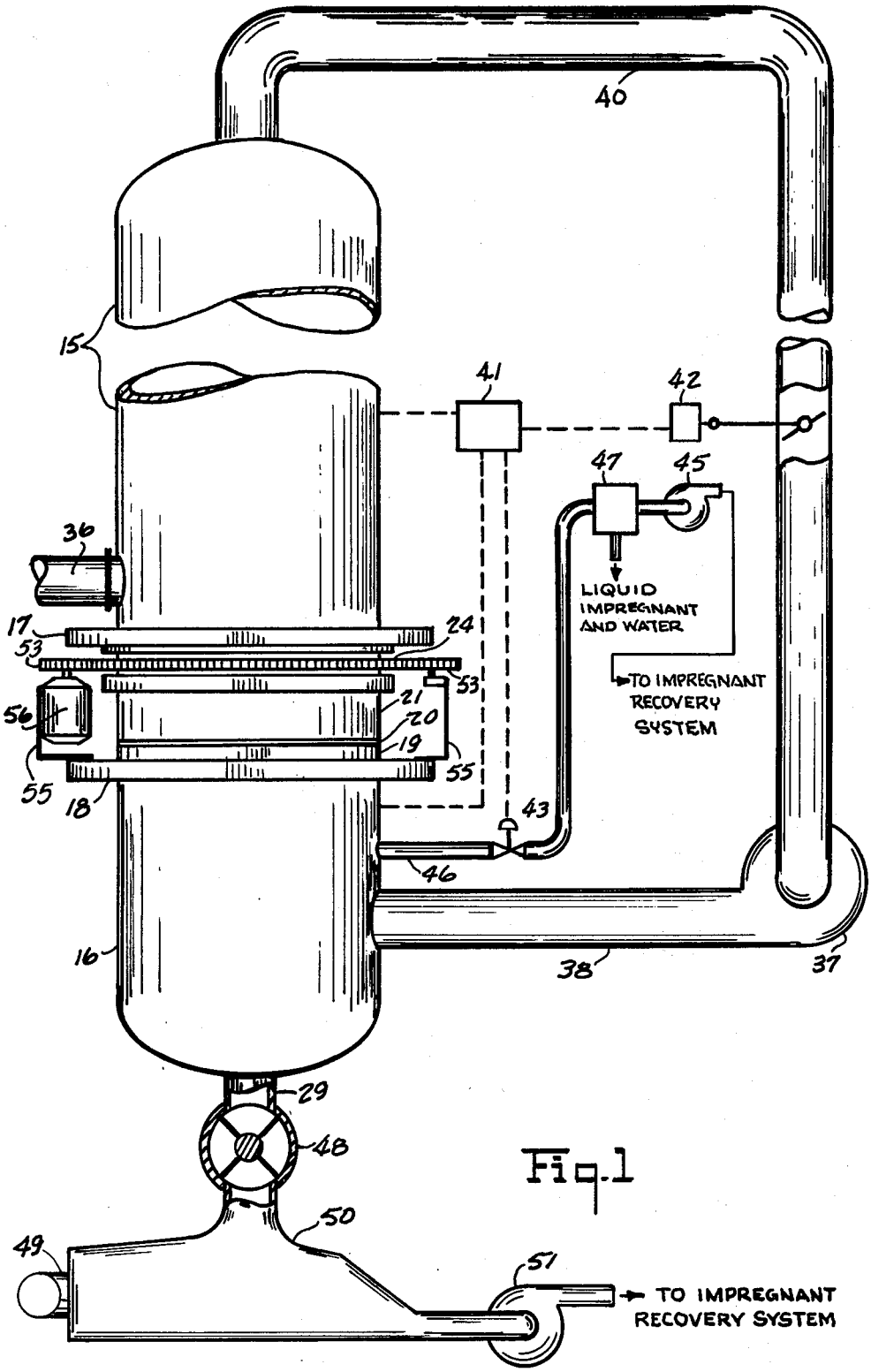
FIG. 1 is a schematic front elevation, partly sectioned, of one embodiment of the present invention showing the tobacco expansion chamber, gas recycling conduits and product collection apparatus.
Figure 2:
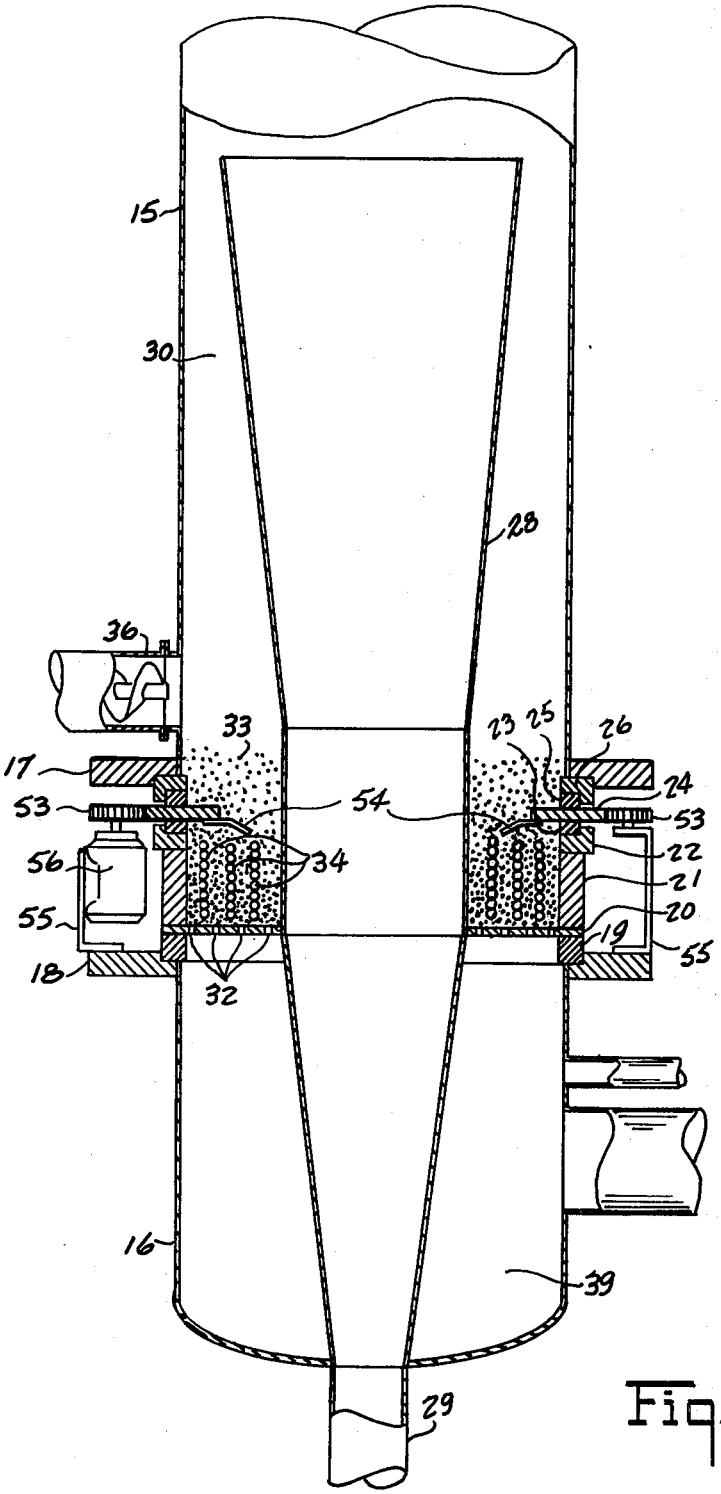
FIG. 2 is a cross sectional view of the lower portion of the tobacco expansion chamber shown in FIG. 1.

The apparatus shown in FIGS. 1 and 2 comprises a vertically arranged vessel of circular cross section that includes an upper chamber 15 and a lower chamber 16 held in aligned relationship by means of flanges 17 and 18 and suitable connecting bolts (not shown). Interposed between flanges 17 and 18 is a metal ring-shaped orifice means 20 sandwiched between metal spacer rings 19 and 21 along with a rotatable ring 24 disposed between carbon rings 23 and 25 (FIG. 2) and metal retaining rings 22 and 26. A funnel-shaped product discharge hopper 28 is concentrically positioned within the lower portion of upper chamber 15 and extends downwardly in contacting relationship with and through the center of ring-shaped orifice means 20. Discharge hopper 28 continues downwardly through lower chamber 16 with the constricted portion 29 of the hopper protruding from and in sealing engagement with an opening in the bottom of lower chamber 16. The upper extremity of discharge hopper 28 terminates at a point approximately one third of the distance between flange 17 and the top of upper chamber 15. The annular passageway 30 between the walls of upper chamber 15 and discharge hopper 28 becomes smaller in cross sectional area near the upper extremity of discharge hopper 28 in order to provide an increase in velocity of the gas stream which is directed upwardly through passageway 30.

As shown in FIG. 2, orifice means 20 is provided with holes or orifices 32 for distributing and directing a gas stream upwardly into annular passageway 30. Orifice means 20 also serves as a support for the bed of solid inert particles 33 which are disposed in the lower portion of annular passageway 30. Orifices 32 are arranged in four circular rows which are uniformly and concentrically positioned in the portion of orifice means 20 adjacent to annular passageway 30. Disposed immediately above the three intermediate areas between the four circular rows of orifices 32 are heating coils 34 comprising metal tubing through which a suitable heating fluid such as steam or hot oil is passed. The static depth of bed of solid inert particles 33 is such that heating coils 34 are completely surrounded by inert particles 33. The size and number of orifices 32 in orifice means 20 are determined by the degree of fluidization of particles 33 that can be achieved by the gas stream passing upwardly through orifices 32.

Impregnated tobacco is introduced into upper chamber 15 through screw conveyor 36 and drops into the bed of solid inert particles 33 which is maintained in a fluidized state by an upwardly moving gas stream that is generated by fan 37. The gas stream is recirculated through the system via conduits 38 and 40 and the velocity of the gas stream passing through the bed of solid inert particles 33 is regulated by control means 41. Control means 41 monitors and maintains the desired pressures in plenum 39 and in the top part of upper chamber 15 by sending appropriate signals to damper control 42 and control valve 43. The pressure in the top part of upper chamber 15 is preferably maintained at pressures slightly below atmospheric during normal operation of the apparatus. A portion of the recircling gas stream is withdrawn from plenum 39 by means of fan 45, conduit 46 and control valve 43 while condenser means 47 effects partial recovery of impregnating agent from the withdrawn gas stream.

The velocity of the gas stream passing through orifice means 20, as regulated by control means 42, must be sufficient to effect fluidization of the bed of solid inert particles 33 and to entrain expanded tobacco in the upwardly flowing gas stream. As the tobacco-containing gas stream emerges from annular passageway 30 and rises above discharge hopper 28, its velocity decreases sufficiently to allow the entrained tobacco to fall by gravity into hopper 28. The expanded tobacco product passes downwardly through the constricted portion 29 of hopper 28 and through air lock 48 before dropping onto conveyor belt 49. Conveyor belt 49 is partially enclosed by hood system 50 which is connected to fan 51 for collection of any impregnant vapors which may be associated with the expanded tobacco product emerging from air lock 48. If necessary, the expanded tobacco product may be moistened or reordered by installing a suitable water spraying device above conveyor belt 49.

Figure 3:
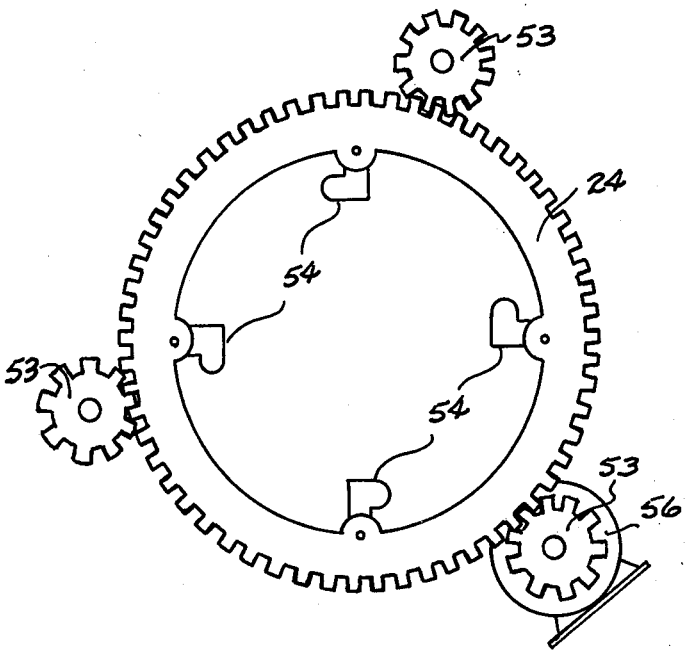
FIG. 3 is a plan view of the rotatable ring depicted in FIGS. 1 and 2 giving additional details of construction.

FIG. 3 shows a plan view of rotatable ring 24 and associated gear wheels 53. Rigidly attached to four uniformly spaced inward projections of the inner edge of ring 24 are plows 54 which extend into the bed of solid inert particles 33 (FIG. 2). Support means 55 (FIG. 1) are employed to maintain gear wheels 53 at fixed, pre-determined locations that will, in turn, keep rotatable ring 24 in proper alignment with respect to annular passageway 30 (FIG. 2). One or more gear wheels 53 is provided with drive means 56 for effecting rotation at desired speeds of ring 24. The rotation of ring 24 and attached plows 54 serve to move impregnated tobacco introduced through screw conveyor 36 (FIG. 2) away from the initial point of entry and to distribute the tobacco more uniformly throughout the bed of solid inert particles 33. An alternative to rotatable ring 24 and equipment associated therewith is the utilization of two or more tobacco conveyors 36 equally spaced around the vertical axis of annular passageway 30 to achieve more uniform distribution of impregnated tobacco in the fluidized bed of solid inert particles.

Prior to operation of the apparatus shown in FIG. 1, it is usually necesary to apply suitable insulating materials to the exterior surfaces of chambers 15 and 16 and the conduits through which the gas stream is recirculated. These insulating materials serve to minimize accumulation of water and/or impregnant condensates in the apparatus which could adversely affect the efficiency of the process. Depending on the size of the apparatus and the effectiveness of the insulating materials, it may be desirable to provide external heating at selected points where heat losses tend to be excessive.

Figure 4:
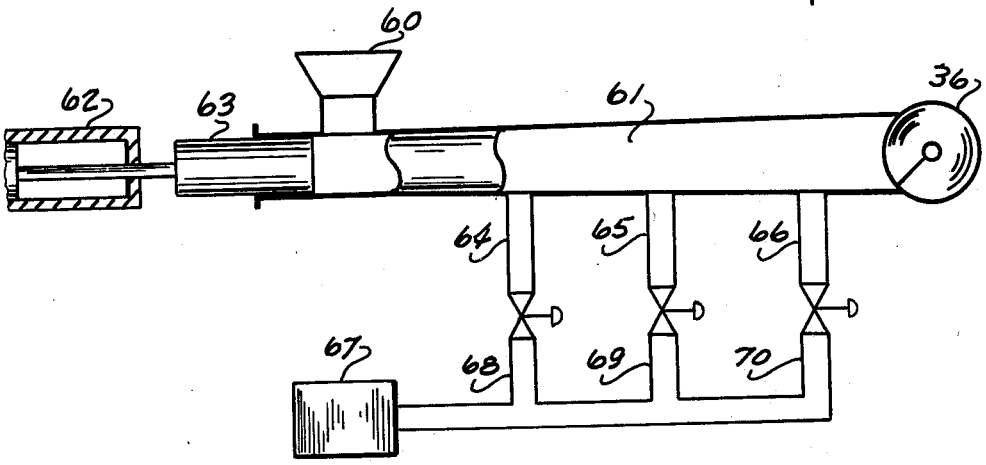
FIG. 4 is a schematic cross sectional view of a tobacco impregnating device suitable for use in conjunction with the tobacco expansion devices disclosed herein.
Figure 5:
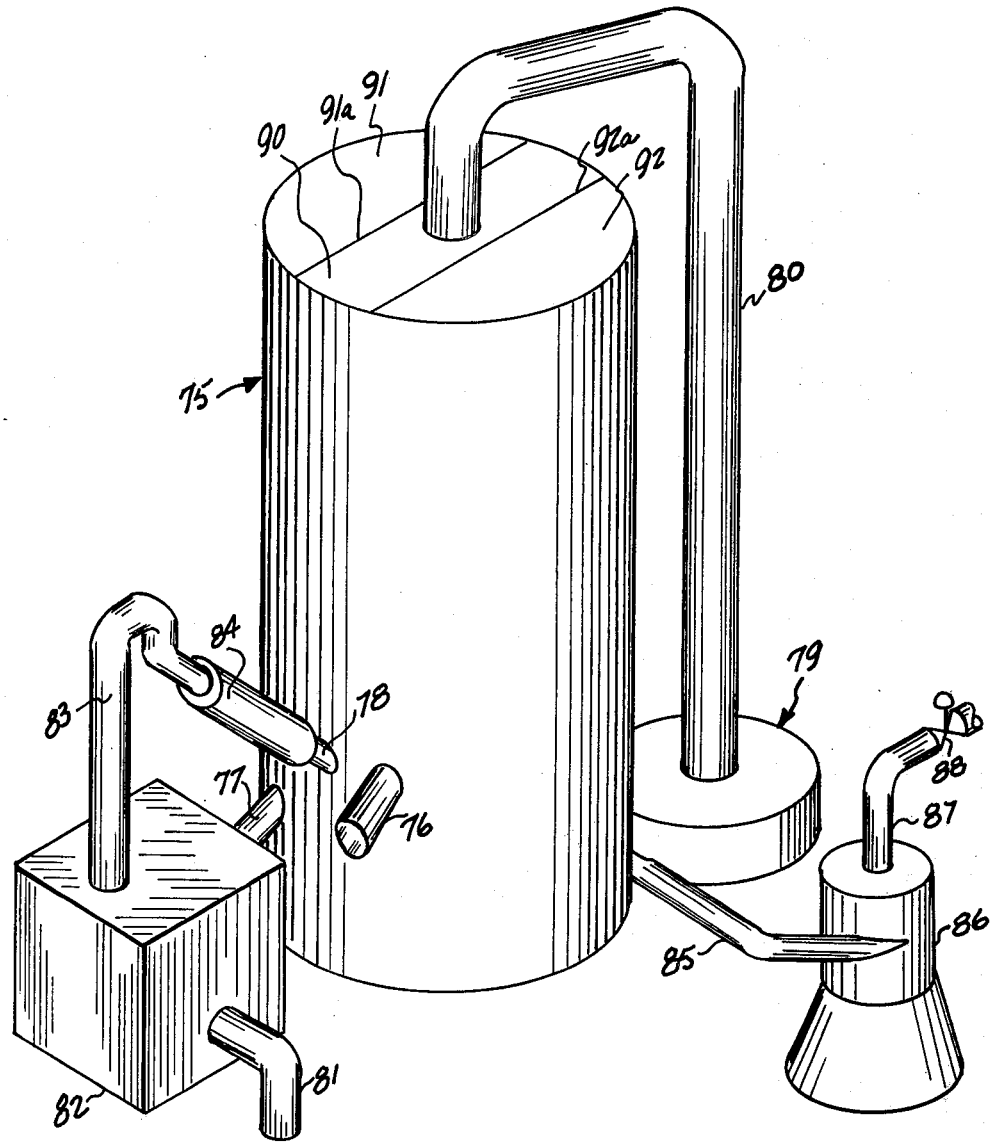
FIG. 5 is a perspective view of apparatus representing a second embodiment of the present invention showing a tobacco expansion chamber, fan assembly, dust collector and certain apparatus associated therewith.

FIG. 4 depicts apparatus that is particularly preferred for preparing the impregnated tobacco that is introduced into the apparatus shown in FIG. 1. Cut tobacco is fed into the apparatus through tobacco feed hopper 60 and the tobacco is then moved through tunnel 61 by reciprocating motor 62 and plunger 63. Tunnel 61 has slightly diverging side walls to reduce undue compaction of the tobacco as it is pushed through the tunnel. Plunger 63 is preferably provided with grooves on the surface thereof which are generally aligned with the longitudinal axis of the plunger to allow air to escape from the tobacco during the tobacco compression strokes of the plunger. Tunnel 61 is provided with inlets 64, 65 and 66 through which hot vapors of the desired impregnating agent (e.g., trichloromonofluoromethane, pentane, propanol, etc.) is introduced to impregnate the moving tobacco. The vapors are supplied by vapor generator 67 and control valves 68, 69 and 70 are employed to regulate the flow to each of the inlets 64, 65 and 66, respectively. The walls of tunnel 61 are preferably fabricated of a suitable metal having high heat conductivity to enhance the dissipation of heat derived from the hot impregnant vapors and the mechanical action of plunger 63. Dissipation of the heat aids the impregnation process by allowing slight cooling of the tobacco which, in turn, promotes increased condensation of impregnant vapors on the surface of the tobacco. Alternatively, portions of tunnel 61 between inlets 64, 65 and 66 as well as immediately upstream of inlet 64 and downstream of inlet 66 may be jacketed to permit localized cooling of the tobacco. After passing through tunnel 61 the impregnated tobacco passes directly into screw conveyor 36 (see FIG. 2) for transfer to the tobacco expansion apparatus previously described.

The contemplated best mode of the presently disclosed invention is shown in FIGS. 5 through 9. The apparatus comprises a cylindrically-shaped tobacco expansion chamber 75 equipped with impregnated tobacco inlet 76, inert bead discharge chute 77, inert bead inlet 78, fan assembly 79 and conduit 80 for recycling of the fluidizing gas stream. Inert beads emerging from chamber 75 through discharge chute 77 are passed through separator 82 where any dense tobacco particles such as stems are separated from the inert beads by suitable means such as diverging tines which allow the beads to pass between the tines while retaining the tobacco particles. The separated dense tobacco particles are discharged through conduit 81. Elevator means 83 transfers the inert beads from separator 82 to inert bead inlet 78 and inlet 78 is provided with heating means 84 to increase the temperature of the inert beads prior to reentry into chamber 75. Dust entrained in the recirculating gas stream is skimmed from fan assembly 79 by dust skimmer 89 (FIG. 8) and routed through conduit 85 to centrifugal dust collector 86. Conduit 87 is connected to the gas outlet of dust collector 86 and to an appropriate vacuum source (not shown) with control valve 88 being used to regulate the volume of gas withdrawn from fan assembly 79. Dust collector 86 is provided with suitable means for periodically discharging dust that has accumulated during operation of the apparatus. The top of expansion chamber 75 comprises panel 90, which is firmly secured to the side walls of chamber 75, and panels 91 and 92 which are connected to panel 90 by hinges **91*a* and 92*a*, respectively. Panels 91 and 92 are maintained in contacting relationship with the side walls of expansion chamber 75 during normal operation of the apparatus by means of suitable retaining devices that are designed to release panels 91 and 92 in the event that a sudden large pressure increase occurs in chamber 75**.

Figure 6:
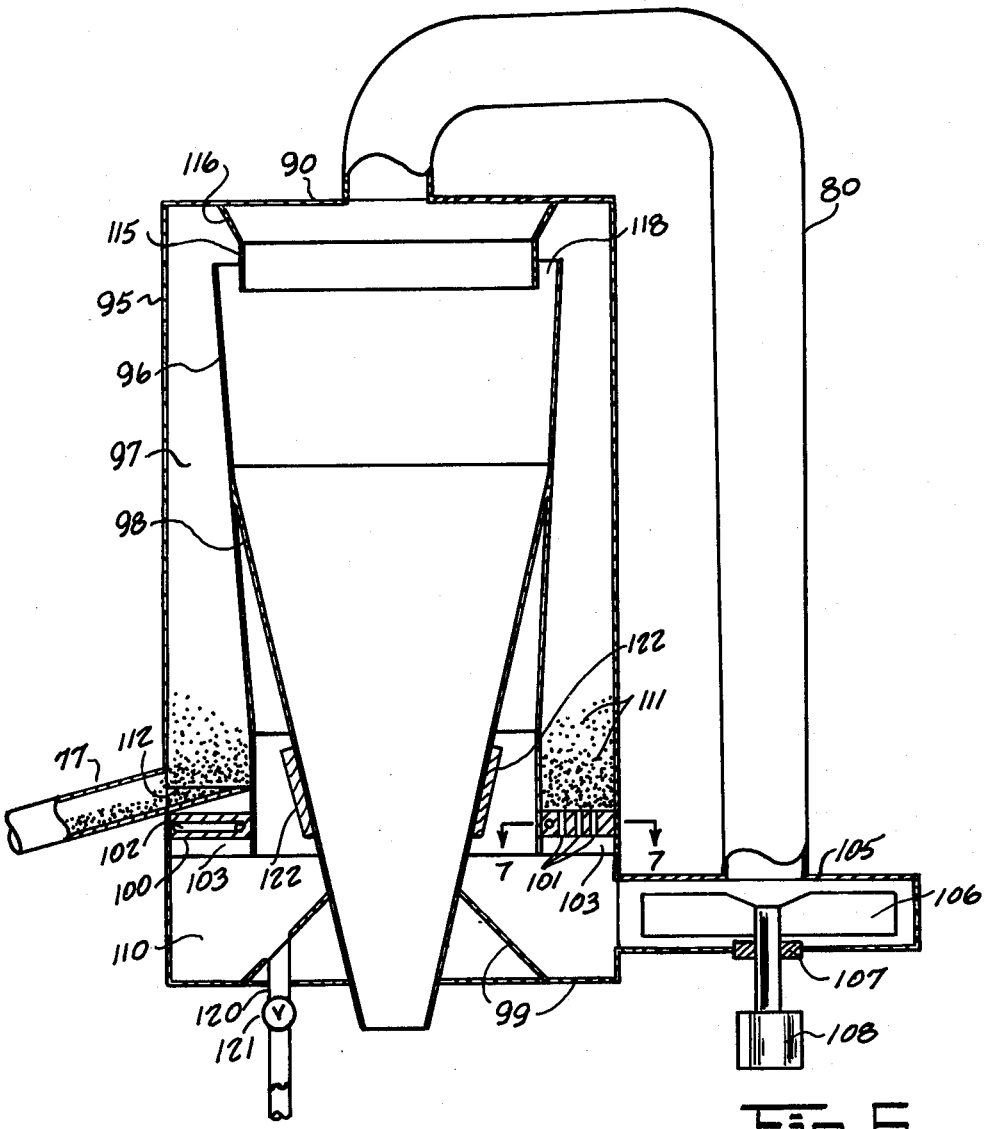
FIG. 6 is a cross sectional view of the tobacco expansion chamber, fan assembly and connecting conduit shown in FIG. 5.
Figure 7:
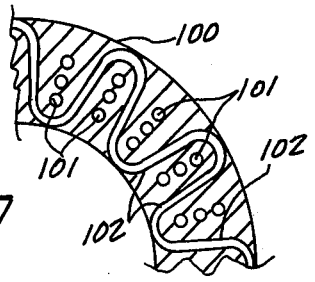
FIG. 7 is a horizontally expanded section taken along line 7—7 of FIG. 6.
Figure 8:
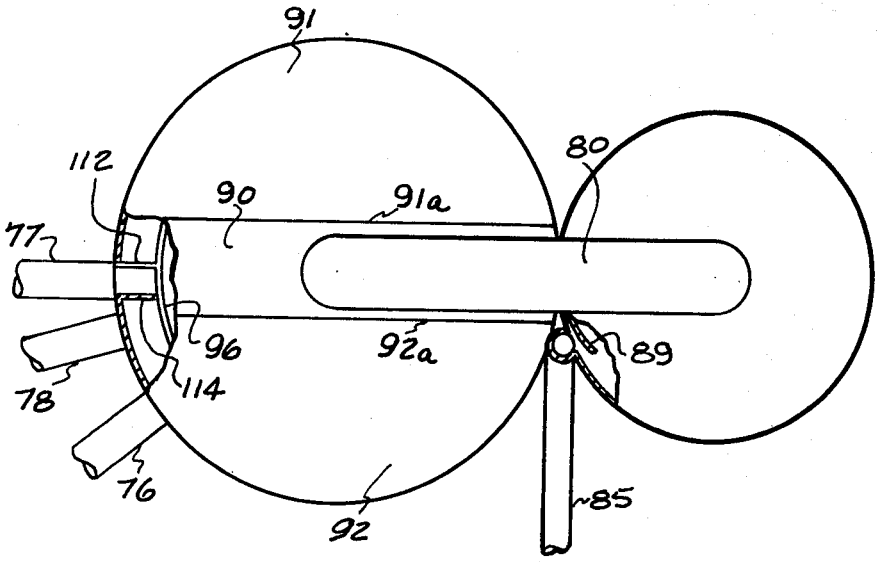
FIG. 8 is a plan view of the tobacco expansion chamber and fan assembly shown in FIG. 5, partly sectioned to show additional details of construction.
Figure 9:
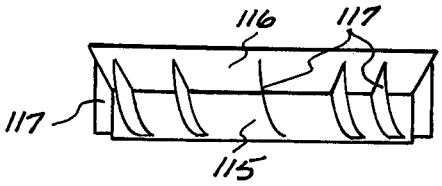
FIG. 9 is a side view of a preferred modification of a portion of the tobacco expansion chamber shown in FIG. 6.

As seen in the cross sectional view of FIG. 6, the cylindrically-shaped outer shell 95 of tobacco expansion chamber 75 has concentrically positioned therein an inner shell 96 having a short cylindrical lower portion and an elongated cone frustrum upper portion. The cone frustrum upper portion of inner shell 96 diverges slightly from the vertical so that the gradually decreasing cross-sectional area of annular passageway 97 causes an increase in the velocity of the gas stream moving upwardly through the passageway. Concentrically disposed within inner shell 96 is product discharge hopper 98 whose upper rim is in contacting relationship with the inside wall of inner shell 96. The lower end of discharge hopper 98 protrudes from the bottom of expansion chamber 75 and is in sealing engagement with the cone frustrum section of panel 99 which forms the bottom of chamber 75. In a horizontal plane adjacent to inert bead discharge chute 77 is orifice means 100 which comprises a flat, centerless disc whose outer and inner edges are affixed to outer shell 95 and inner shell 96, respectively. Orifice means 100 is provided with a plurality of vertically oriented holes or orifices 101 which are radially arranged and occupy approximately 10 percent of the surface area of the disc. The thickness of orifice means 100 is such that a series of horizontal holes 102 can be introduced into the disc in alternating fashion with vertical holes 101 as shown in FIG. 7. The horizontal holes 102 are connected by suitable means to form a continuous conduit through which a heating fluid such as hot oil can be passed. Located directly underneath and radially aligned with each horizontal hole 102 is a rectangularly shaped baffle 103, approximately 1-2 mm thick, which serves to equilibrate the gas flow through the vertically oriented orifices 101. Fan assembly 79 comprises fan housing 105, fan 106, fan bearing 107 and fan motor 108. The recirculating gas stream is forced from fan housing 105 into high pressure plenum 110 and then upwardly through orifices 101 into a bed of inert beads 111. The speed of fan motor 108 is regulated by a velocity pressure transmitter and indicating controller to insure that uniform fluidization of the bed of inert beads is maintained.

The depth of the bed of inert beads is controlled by dam 112 which extends radially from inner shell 96 to outer shell 95 at a point immediately adjacent to inert bead discharge chute 77. The height of the dam above the top surface of orifice means 100 is adjusted to give the desired depth of the fluidized bed of inert beads. The point of entry for inert bead inlet 78 into tobacco expansion chamber 75 (see FIG. 5) must be sufficiently higher than the contemplated maximum height of dam 112 so that there is a steady migration of inert beads in a counterclockwise direction through annular passageway 97 as viewed from above. It is apparent that the rate of migration of the inert beads from inlet 78 to discharge chute 77 will depend on the relative depths of the inert bead bed at those two points. The depth of the bed of inert beads at inlet 78 is, in turn, determined by the rate at which the inert beads are transferred from discharge chute 77 to inlet 78. The combination of the high elevation of inert beads at inlet 78 relative to the elevation of dam 112 and the fluidizing gas stream which is directed upwardly through the bed of inert beads causes the beads to flow "downhill" towards dam 112. This movement of the beads also results in impregnated tobacco being moved away from impregnated tobacco inlet 76. The impregnated tobacco inlet 76 is preferably connected to expansion chamber 75 at about the same elevation as that of inert bead inlet 78. Alternatively, inert bead inlet 78 can be modified so that both the impregnated tobacco and the inert beads can be fed into chamber 75 through a common inlet. The inert beads emerging from chamber 75 through inert bead discharge chute 77 may contain tobacco particles which are too dense to be carried into product discharge hopper 98. To insure that such particles are forced to exit through inert bead discharge chute 77, expansion chamber 75 is provided with a vertical baffle 114 (FIG. 8) adjacent to inert bead discharge chute 77 with the baffle extending from orifice means 100 to panel 90 and being in sealing engagement with outer shell 95 and inner shell 96.

As shown in FIG. 6 the upper extremity of inner shell 96 terminates at a point that is a short distance below panel 90. Cooperating with the upper extremity of inner shell 96 to form entry nozzle 118 for the tobacco-containing gas stream is right circular cylinder 115 whose diameter is slightly less than the diameter of the upper extremity of inner shell 96 so that the velocity of the gas stream will increase as it passes through nozzle 118. Cylinder 115 is rigidly secured to cone frustum 116 which, in turn, is firmly attached to panel 90. It is preferred that cylinder 115 and cone frustum 116 be provided with a plurality of vanes 117 (see FIG. 9) uniformly spaced around the periphery of cylinder 115 and cone frustum 116. Vanes 117 are shaped so as to divert the tobacco-containing gas stream to a direction that is about 15° below horizontal.

During normal operation of the apparatus the pressure within the product discharge hopper 98 is maintained at essentially atmospheric pressure by control valve 88 which is responsive to a pressure sensing device (not shown) located in discharge hopper 98. The expanded tobacco product falling by gravity from the bottom of product discharge hopper 98 may be collected in containers or on a suitable conveying device for routing to storage areas. Since the tobacco being expanded in the presently disclosed apparatus may be impregnated with a flammable impregnating agent, conduit 120 (FIG. 6) and associated valve 121 are provided for admitting an inert gas into the apparatus for purging purposes during start-up and shut-down. In the event that explosive mixtures in plenum 110 should ignite, rupture discs 122 located on product discharge hopper 98 allow pressure and combustion products to be vented upwardly through the openings that are normally sealed by panels 91 and 92. Similarly, ignition of combustible mixtures in annular passageway 97 would also be vented via the openings associated with panels 91 and 92.

In order to prevent unwanted condensation of water and/or tobacco impregnating agent in tobacco expansion chamber 75 and conduit 80, suitable insulating materials are applied to the exterior surfaces of chamber 75 and conduit 80. Additionally, supplemental heating of the insulation-wrapped surfaces by means such as electrical heating tape or steam coils is desirable.

The following examples will serve to further illustrate the advantages of the present invention:

EXAMPLE 1

Cut flue cured tobacco containing 30 percent moisture and impregnated with trichloromonofluoromethane equivalent to 60 percent by weight based on the dry weight of the tobacco was expanded by contacting the impregnated tobacco with finely divided sand that was maintained in a fluidized state. A commercial fluidized sand bath (Tecam Fluidized Bath, Model S.B.S.2) available from Techne Inc. of Princeton, New Jersey 08540, was employed for this purpose. The particles of sand ranged between 0.12 and 0.17 millimeter in diameter and fluidization was achieved by passing air upwardly through the sand. The fluidized sand bath was maintained at 200° C. while approximately one-gram portions of impregnated tobacco were completely immersed in the bath for about 10 seconds. Immersion of the impregnated tobacco into the fluidized sand bath and subsequent recovery thereof was facilitated by placing the tobacco in a round screen basket approximately 5 centimeters in diameter and 5 centimeters deep. The screen fabric used for forming the basket had 1 millimeter square openings which allowed the sand particles to pass easily through the screen fabric while retaining substantially all of the tobacco contained in the basket. Tobacco expanded in this manner was found to have a filling value of 27.3 milliliters/3 grams after moisture equilibration. This represents an increase of 120 percent over the control sample which had a filling value of 12.4 milliliters/3 grams.

EXAMPLE 2

Figure 10:
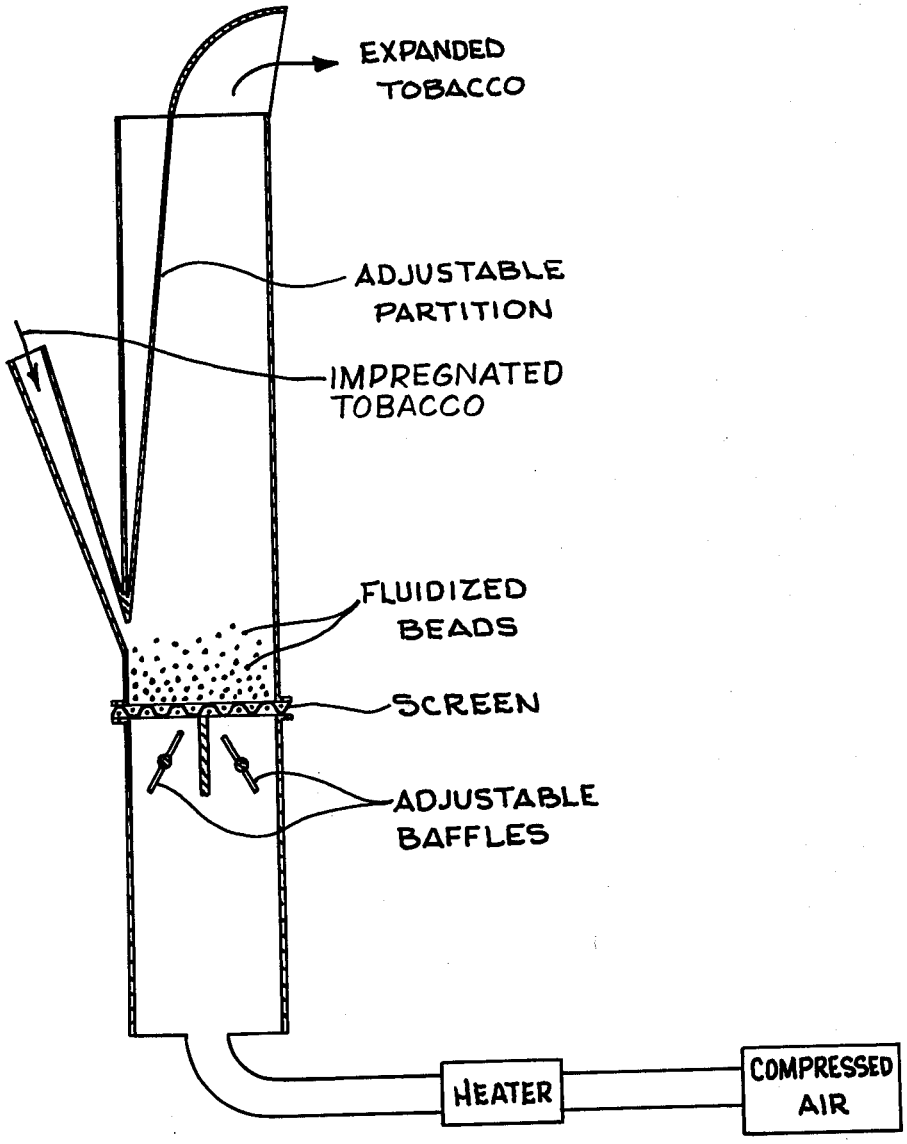
FIG. 10 is a schematic cross sectional view of a further embodiment of the present invention.

Tobacco was expanded using special apparatus similar to that shown in FIG. 10 comprising a first vertically arranged 10 centimeter square metal duct measuring approximately 38 centimeters in height and a second vertically arranged 10 centimeter square metal duct measuring approximately 21 centimeters in height with one end of each metal duct being provided with a flange. The flange ends of the two ducts were joined in aligned relationship to form a single chamber with the upper and lower portions separated by a horizontally disposed 14 centimeter square wire screen with 0.21 millimeter openings interposed between the joined flange ends of the ducts. The vertical arrangement of the chamber was such that the 21 centimeter duct constituted the lower portion of the apparatus. The lower end of the 21 centimeter duct was sealed with a metal plate and was provided with an inlet through which heated air (about 200° C.) was introduced. The 21 centimeter duct was also provided with two adjustable baffles positioned immediately below the wire screen to provide directional control over the heated air moving upwardly through the screen and through a bed of cylindrically-shaped aluminum beads supported by the wire screen. Each bead measured 0.75 millimeter in diameter by 0.75 millimeter in length and approximately 300 grams of beads were used to cover the wire screen to a depth of about 2 centimeters. The heated air was supplied by a cylinder of compressed air and a series of 9.5 millimeter diameter heated metal coils through which the air was passed. A valve assembly on the compressed air cylinder provided means for regulating the flow of air through the heated metal coils and the bed of aluminum beads at a rate sufficient to fluidize the bead bed to a maximum height of about 5 centimeters during operation of the apparatus.

One wall of the 38 centimeter duct constituting the upper portion of the chamber was provided with an opening for introducing impregnated tobacco into the chamber. The opening measured about 1.5 centimeters in height by 10 centimeters in width and was located approximately 5 centimeters above the wire screen separating the upper and lower portions of the chamber. A feed hopper was attached to this opening to facilitate feeding the impregnated tobacco into the chamber. Attached to the inside wall of the chamber at a point immediately above the 1.5×10 centimeter opening was an adjustable partition measuring about 10×30 centimeters. This adjustable partition divided the upper portion of the chamber into two zones of unequal volume with the chamber wall having the 1.5×10 centimeter impregnated tobacco feed opening and the partition forming opposing sides of the smaller of the two zones. The upper end of the partition was adjusted to a position which gave a 6.7×10 centimeter opening at the upper end of the larger of the two zones. The top of the chamber adjacent to the 6.7×10 centimeter opening was provided with a deflector which directed the upwardly moving gaseous medium in a generally horizontal direction as it exited from the chamber. Expanded tobacco entrained in the exiting hot air stream was recovered by allowing it to fall by gravity into a receptacle located adjacent to the chamber.

A sample of cut flue-cured tobacco strips containing 30 percent moisture was thoroughly impregnated with a quantity of ethanol equivalent to 43 percent by weight based on the dry weight of the tobacco. The impregnated tobacco was then gradually fed into the fluidized bead bed apparatus described above and the expanded tobacco carried out of the puffing chamber by the hot air stream was collected. The moisture content of the expanded tobacco was equilibrated to about 12 percent by placing in a 60 percent relative humidity chamber overnight. Measurement of the filling value by the method described in U.S. Pat. No. 3,683,937 revealed a value of 24.2 milliliters/3 grams as compared with 11.9 milliliters/3 grams for a control sample having a similar moisture content. This corresponds to an increase of 103 percent in filling value.

EXAMPLE 3

The procedure of Example 2 was repeated except that the aluminum beads were removed from the puffing chamber so that the impregnated tobacco was expanded solely by the heated air. In contrast to operating results with the fluidized bed, the filling value of the expanded tobacco was found to be 16.0 milliliters/3 grams (after adjusting to 12 percent moisture) or an increase of 34 percent over the control sample.

EXAMPLE 4

The procedure of Example 2 was repeated except that the tobacco had an initial moisture content of 11.3 percent, the quantity of ethanol used for impregnation was equivalent to 22.5 percent by weight based on the dry tobacco weight, and the temperature of the heated air was 210° C. The filling value for the expanded tobacco after moisture equilibration was found to be 25.3 milliliters/3 grams or an increase of 113 percent over the control sample.

EXAMPLE 5

The procedure of Example 2 was repeated except that tobacco containing 20 percent moisture was impregnated with a quantity of trichloromonofluoromethane equivalent to 44 percent by weight based on the dry weight of the tobacco. The filling value for the expanded tobacco after moisture equilibration was found to be 33 milliliters/3 grams or an increase of 177 percent over the control sample.

EXAMPLE 6

The procedure of Example 2 was repeated except that the tobacco was impregnated by contacting it with hot ethanolic vapors for approximately 5 seconds and the temperature of the heated air used for fluidizing and heating the beads was 190° C. The quantity of ethanol vapors condensing on the tobacco was not determined but the impregnated tobacco withdrawn from contact with the hot ethanolic vapors was immediately fed into the fluidized bead bed. The filling value for the expanded tobacco after moisture equilibration was found to be 27.3 milliliters/3 grams or an increase of 129 percent over the control sample.

EXAMPLE 7

The procedure of Example 2 was repeated except that the cut Burley tobacco was used instead of flue-cured tobacco and the quantity of ethanol used for impregnation was equivalent to 50 percent by weight based on the dry weight of the tobacco. The filling value for the expanded tobacco after moisture equilibration was found to be 28.8 milliliters/3 grams or an increase of 103 percent over the control sample which had a filling value of 14.3 milliliters/3 grams at comparable moisture levels.

EXAMPLE 8

The procedure of Example 2 was repeated except that the tobacco was impregnated with a quantity of 2-propanol equivalent to 50 percent by weight based on the dry weight of the tobacco and the temperature of the heated air was 160° C. The filling value for the expanded tobacco after moisture equilibration was found to be 23.9 milliliters/3 grams or an increase of 101 percent over the control sample.

EXAMPLE 9

The procedure of Example 2 was repeated except that the tobacco was impregnated with a quantity of pentane equivalent to 60 percent by weight based on the dry weight of the tobacco and the temperature of the heated air was 135° C. The filling value for the expanded tobacco after moisture equilibration was found to be 23.5 milliliters/3 grams or an increase of 97 percent over the control sample.

EXAMPLE 10

Apparatus similar to that shown in FIGS. 1, 2 and 3 was used to expand cut tobacco impregnated with 2-propanol. The outer and inner diameters of the annular passageway in which 0.75 millimeter×0.75 millimeter cylindrically-shaped aluminum beads were disposed measured 30.5 centimeters and 21.5 centimeters, respectively. The static depth of the bed of aluminum beads was approximately 10 centimeters. Expanded tobacco product was withdrawn from the apparatus through two manually operated gate valves rather than a continuous type air lock discharge valve and no attempt was made to recover impregnant from the portion of the recirculating gas stream that was withdrawn. The orifice means supporting the bed of aluminum beads was provided with 412 uniformly spaced holes with each hole having a diameter of about 3 millimeters. Automatic control means were used to maintain a pressure drop of about 13 to 14 centimeters of water across the fluidized bead bed during operation of the apparatus. The impregnated tobacco introduced into the fluidized bead bed was prepared by passing the tobacco through vapor impregnation apparatus similar to that shown in FIG. 4.

A cut tobacco mixture comprising Burley tobacco blended with minor proportions of flue-cured tobacco and having a moisture content of 16.3 percent was impregnated with vapors obtained by distilling an azeotropic mixture of 2-propanol and water to give impregnated tobacco containing 33.9 percent by weight 2-propanol based on the dry weight of the tobacco. The impregnated tobacco was introduced into the fluidized bed of aluminum beads at a rate of 1.82 kilograms per hour. The temperature of the fluidized bed was 185° C. The expanded tobacco product withdrawn from the apparatus was sprayed with sufficient water to increase the moisture content of the expanded tobacco to about 12 percent. After equilibration, the reordered expanded tobacco was found to have a filling value that was 113 percent greater than a control sample having the same moisture content.

EXAMPLE 11

The procedure of Example 10 was repeated except that cut flue-cured tobacco having an initial moisture content of 17 percent was impregnated to give 29.3 percent by weight 2-propanol based on the dry weight of the tobacco. The impregnated tobacco was introduced into the fluidized bed of beads at a rate of 2.27 kilograms per hour with the temperature of the bed being maintained at 187° C. The resulting expanded tobacco was reordered and was found to have a filling value that was 95 percent greater than a control sample having the same moisture content.

While particular embodiments of the present invention have been described in the foregoing, it is apparent that any number of other modifications may be made without departing from the spirit and scope of the appended claims.

What is claimed is:

1. A process for expanding tobacco impregnated with an expansion agent which comprises introducing the impregnated tobacco into a fluidized bed of hot inert solid particles to effect rapid vaporization or expansion of said expansion agent with concomitant expansion of the tobacco, said particles having maximum and minimum dimensions in the range of 0.10 to 5 millimeters, and separating the expanded tobacco from the fluidized bed.

2. The process of claim 1 in which a rapidly moving gas stream heated to a temperature between 100° and 300° C. is used to heat said particles and to maintain said particles in a fluidized state.

3. The process of claim 2 in which the expansion agent in the impregnated tobacco comprises an organic compound capable of rapid vaporization at the temperature prevailing in the fluidized bed.

4. The process of claim 3 in which the organic compound is an aliphatic alcohol.

5. The process of claim 3 in which the organic compound is a hydrocarbon.

6. The process of claim 3 in which the organic compound is a halogenated hydrocarbon.

7. A continuous process for expanding tobacco which comprises establishing and maintaining a fluidized bed of hot inert solid particles with said particles having maximum and minimum dimensions in the range of 0.10 to 5 millimeters, introducing a stream of tobacco impregnated with an expansion agent into said fluidized bed to effect rapid vaporization or expansion of said expansion agent with concomitant expansion of the tobacco, and withdrawing the expanded tobacco from the fluidized bed.

8. The process of claim 7 in which said hot inert solid particles have a temperature between 100° and 300° C.

9. The process of claim 8 in which said expansion agent in the impregnated tobacco comprises an organic compound capable of rapid vaporization at the temperature prevailing in the fluidized bed.

10. The process of claim 9 in which said organic compound is an aliphatic alcohol.

11. The process of claim 9 in which said organic compound is a hydrocarbon.

12. The process of claim 9 in which said organic compound is a halogenated hydrocarbon.

13. The process of claim 7 in which said inert solid particles are metal beads.

14. A continuous process for expanding tobacco in which a stream of tobacco impregnated with an expansion agent is passed into a heating zone where the impregnated tobacco is rapidly heated by a moving hot gas stream to effect rapid vaporization or expanstion of said expansion agent with concomitant expansion of the tobacco and the expanded tobacco is withdrawn from the heating zone, said process being characterized by the fact that the heating zone includes a bed of inert solid particles which is heated and maintained in a fluidized state by the moving hot gas stream with the particles having maximum and minimum dimensions between 0.10 and 5 millimeters.

15. The process of claim 10 in which the inert solid particles are heated to a temperature between 100° C. and 300° C.

16. The process of claim 14 in which the inert solid particles are metal beads.

17. The process of claim 14 in which the moving hot gas stream is withdrawn from the heating zone, is reheated and is recirculated to the heating zone.

18. A continuous process for expanding tobacco which comprises establishing and maintaining a fluidized bed of inert solid particles in an annular passageway by passing a gas stream upwardly through the bed of inert solid particles and the annular passageway, heating the inert solid particles by heating means located adjacent to the bed of inert solid particles, introducing a stream of tobacco impregnated with an expansion agent into the fluidized bed of hot inert solid particles to effect rapid vaporization or expansion of said expansion agent with concomitant expansion of the tobacco, continuing the upward flow of the gas stream so that expanded tobacco is carried upwardly by the gas stream until it emerges from the annular passageway, and recovering the expanded tobacco by allowing it to fall by gravity into collection means which are concentrically and adjacently positioned with respect to the annular passageway, said process being further characterized by the fact that the inert solid particles have maximum and minimum dimensions between 0.10 and 5 millimeters.

19. The process of claim 18 in which the inert solid particles are heated to a temperature between 100° and 300° C.

20. The process of claim 19 in which said expansion agent in the impregnated tobacco comprises an organic compound capable of rapid vaporization at the temperature prevailing in the fluidized bed.

21. The process of claim 20 in which said organic compound is an aliphatic alcohol.

22. The process of claim 20 in which said organic compound is a hydrocarbon.

23. The process of claim 20 in which said organic compound is a halogenated hydrocarbon.

24. The process of claim 18 in which the inert solid particles are metal beads.

25. The process of claim 18 in which the impregnated tobacco introduced into the fluidized bed is distributed in the bed by mechanical stirring means.

26. The process of claim 18 in which the bed of inert solid particles moves through the annular passageway in a direction generally perpendicular to the upwardly flowing gas stream and the inert solid particles are continuously withdrawn from and reintroduced into the annular passageway.

27. The process of claim 26 in which the inert solid particles withdrawn from the annular passageway are heated prior to reintroduction of the inert solid particles into the annular passageway.

28. Apparatus for expanding tobacco which comprises (a) a vertically arranged chamber having transversely positioned therein porous support means which divides the chamber into an upper portion and a lower portion, (b) a bed of inert solid particles which have maximum and minimum dimensions between 0.10 and 5 millimeters disposed immediately above the porous support means, (c) conduit means for supplying a gas stream to the lower portion of the chamber for subsequent passage through the porous support means into the upper portion of the chamber, (d) means for withdrawing the gas stream from the upper portion of the chamber, (e) means for providing the gas stream with sufficient velocity to effect fluidization of the bed of inert solid particles and to entrain expanded tobacco in the gas stream, (f) means for heating the bed of inert solid particles, (g) means for introducing tobacco impregnated with an expansion agent into the bed of inert solid particles while it is maintained in the fluidized state by the gas stream, and (h) means for recovering expanded tobacco from the gas stream.

29. The apparatus of claim 28 which includes means for heating the gas stream.

30. The apparatus of claim 28 wherein the bed of inert solid particles comprises metal beads.

31. The apparatus of claim 28 wherein the means for recovering expanded tobacco from the gas stream comprises a cyclone separator.

32. The apparatus of claim 28 wherein the means for introducing tobacco impregnated with an expansion agent into the bed of inert solid particles comprises (a) an elongated tunnel provided with a tobacco feed hopper near one end of the tunnel, an impregnated tobacco outlet at the opposite end of the tunnel and a plurality of inlets at spaced intervals between the tobacco feed hopper and impregnated tobacco outlet for introducing vapors of an expansion agent into the tunnel;

(b) reciprocating plunger means slidably positioned in said one end of the tunnel adjacent to the tobacco feed hopper for moving the tobacco through the tunnel;

(c) a vapor generator and control valves for supplying controlled amounts of vapors of the expansion agent to said inlets; and (d) conveyor means for transferring impregnated tobacco from the impregnated tobacco outlet of the tunnel to the bed of inert solid particles.

33. The apparatus of claim 32 wherein the walls of the tunnel diverge slightly so that the cross sectional area of the tunnel at the impregnated tobacco outlet is greater than the cross sectional area of the tunnel adjacent to the tobacco feed hopper.

34. The apparatus of claim 28 wherein portions of the external surfaces of the chamber and conduit means are provided with heating and insulation means.

35. Apparatus for expanding tobacco which comprises (a) a vertically arranged, cylindrically-shaped chamber having side walls, a top end closure and a bottom end closure;

(b) an inner shell of generally circular cross section concentrically positioned within the chamber to define an annular passageway between the inner shell and the side walls of the chamber which are adjacent to the inner shell;

(c) an expanded tobacco product discharge hopper associated with said inner shell with the lower end of the discharge hopper protruding through an opening in the bottom end closure of the chamber;

(d) orifice means comprising a flat, centerless disc transversely positioned in contacting relationship with the side walls of the chamber and the inner shell near the lower extremity of the annular passageway;

(e) a bed of inert solid particles which have maximum and minimum dimensions between 0.10 and 5 millimeters disposed in the annular passageway immediately above the orifice means;

(f) means for directing a gas stream upwardly through the orifice means with sufficient velocity to effect fluidization of the bed of inert solid particles and to entrain expanded tobacco in the upwardly-moving gas stream;

(g) means for heating the inert solid particles;

(h) means for introducing tobacco impregnated with an expansion agent into the bed of inert solid particles while the bed is maintained in the fluidized state by the gas stream;

(i) conduit means associated with an opening in the top end closure of the chamber for withdrawing the gas stream from the chamber; and (j) means for decreasing the velocity and changing the direction of the gas stream emerging from the annular passageway to permit expanded tobacco to fall by gravity through the inner shell and the product discharge hopper for recovery of the expanded tobacco product.

36. The apparatus of claim 35 wherein the means for heating the inert solid particles comprises heating coils disposed in the annular passageway immediately above the orifice means.

37. The apparatus of claim 35 wherein the means for heating the inert solid particles comprises radially disposed conduit means incorporated into the body of the orifice means.

38. The apparatus of claim 35 wherein the bed of inert solid particles comprises metal beads.

39. The apparatus of claim 35 wherein the gas stream withdrawn from the chamber through said conduit means is recirculated to said orifice means.

40. The apparatus of claim 39 which includes dust collector means for removing dust from the gas stream withdrawn from the chamber.

41. The apparatus of claim 39 which includes means for withdrawing a portion of the recirculating gas stream and recovering therefrom quantities of the expansion agent used for impregnating the tobacco.

42. The apparatus of claim 35 which includes pressure relief devices designed to counteract sudden substantial pressure increases within the chamber and associated conduit means.

43. The apparatus of claim 35 wherein portions of the external surfaces of the chamber and conduit means are provided with heating and insulation means.

44. The apparatus of claim 35 which includes inlet and outlet means for continuously introducing into and withdrawing from the annular pasageway said inert solid particles.

45. The apparatus of claim 44 which includes means for separating dense tobacco material from inert solid particles withdrawn from the annular passageway and means for heating the withdrawn inert solid particles prior to reintroducing them into the annular passageway.

46. The apparatus of claim 35 wherein means for introducing tobacco impregnated with an expansion agent into the bed of inert solid particles comprises (a) an elongated tunnel provided with a tobacco feed hopper near one end of the tunnel, an impregnated tobacco outlet at the opposite end of the tunnel and a plurality of inlets at spaced intervals between the tobacco feed hopper and impregnated tobacco outlet for introducing vapors of an expansion agent into the tunnel;

(b) reciprocating plunger means slidably positioned in said one end of the tunnel adjacent to the tobacco feed hopper for moving the tobacco through the tunnel;

(c) a vapor generator and control valves for supplying controlled amounts of vapors of the expansion agent to said inlets; and (d) conveyor means for transferring impregnated tobacco from the impregnated tobacco outlet of the tunnel to the bed of inert solid particles.

47. The apparatus of claim 46 wherein the walls of the tunnel diverge slightly so that the cross sectional area of the tunnel at the impregnated tobacco outlet is greater than the cross sectional area of the tunnel adjacent to the tobacco feed hopper.

* * * * *

UNITED STATES PATENT AND TRADEMARK OFFICE

CERTIFICATE OF CORRECTION

PATENT NO. : 4,270,553

DATED : June 2, 1981

INVENTOR(S) : Lucas J. Conrad; Jackie L. White

It is certified that error appears in the above-identified patent and that said Letters Patent are hereby corrected as shown below:

Column 4, line 36, after "of" (first occurrence) insert --the--.

Column 4, line 56, "recircling" should read --recirculating--.

Column 4, line 62, "42"should read --41--.

Column 6, lines 51, 52 and 62, "frustrum" should read --frustum--.

Column 13, line 3, "expanstion" should read --expansion--.

Column 13, line 12, "10" should read --14--.

Signed and Sealed this

*Eighth* Day of *September 1981*

[SEAL]

*Attest:*

GERALD J. MOSSINGHOFF

*Attesting Officer*

*Commissioner of Patents and Trademarks*